US010621799B2

(12) United States Patent
Okabe et al.

(10) Patent No.: US 10,621,799 B2
(45) Date of Patent: Apr. 14, 2020

(54) INFORMATION PROCESSING APPARATUS AND INFORMATION PROCESSING METHOD

(71) Applicant: TOYOTA JIDOSHA KABUSHIKI KAISHA, Toyota-shi, Aichi-ken (JP)

(72) Inventors: Shinichi Okabe, Nagakute (JP); Hiroaki Sakurai, Nagoya (JP); Kazuaki Takemura, Nagoya (JP); Kengo Takeuchi, Ogaki (JP); Kaori Sakai, Tokyo-to (JP); Hideo Hasegawa, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/438,597

(22) Filed: Jun. 12, 2019

(65) Prior Publication Data

US 2019/0378361 A1 Dec. 12, 2019

(30) Foreign Application Priority Data

Jun. 12, 2018 (JP) ..... 2018-112084

(51) Int. Cl.
*G07C 5/00* (2006.01)
*G07C 5/02* (2006.01)

(52) U.S. Cl.
CPC ..... *G07C 5/02* (2013.01); *G07C 5/008* (2013.01)

(58) Field of Classification Search
CPC ..... G07C 5/02; G07C 5/008
USPC ..... 340/439
See application file for complete search history.

(56) References Cited

U.S. PATENT DOCUMENTS

2013/0226365 A1* 8/2013 Brozovich ..... G06Q 50/30 701/1
2014/0350975 A1* 11/2014 Paperno ..... G06Q 10/02 705/5
2015/0185020 A1* 7/2015 Gimpl ..... G01C 21/3438 701/537
2015/0254581 A1* 9/2015 Brahme ..... G06Q 10/02 705/5
2015/0278712 A1 10/2015 Fujita et al.
2016/0021154 A1* 1/2016 Schoeffler ..... G06Q 10/10 709/204
2016/0187150 A1* 6/2016 Sherman ..... G01C 21/3438 705/7.15
2016/0321771 A1* 11/2016 Liu ..... G06Q 50/30
2016/0364678 A1* 12/2016 Cao ..... G06Q 50/30
2016/0364812 A1* 12/2016 Cao ..... G06Q 50/01
2017/0169366 A1* 6/2017 Klein ..... G06Q 10/025

(Continued)

FOREIGN PATENT DOCUMENTS

JP 2015-191364 A 11/2015

*Primary Examiner* — Ojiako K Nwugo
(74) *Attorney, Agent, or Firm* — Oliff PLC

(57) ABSTRACT

A controller provided at an information processing apparatus is configured to acquire information indicating driving history regarding traveling of a vehicle, specify a traveling section having a distance equal to or longer than a predetermined distance, in which the vehicle repeatedly travels at a frequency equal to or higher than a predetermined frequency, on the basis of the information indicating the driving history, and send a notification to a driver of the vehicle for encouraging the driver to provide ride sharing using the vehicle in the specified traveling section.

5 Claims, 6 Drawing Sheets

(56) References Cited

U.S. PATENT DOCUMENTS

| | | | | |
|---|---|---|---|---|
| 2018/0137593 | A1* | 5/2018 | Djuric | G06Q 50/30 |
| 2019/0005412 | A1* | 1/2019 | Matus | G07C 5/085 |

* cited by examiner

*FIG. 3*

| | | |
|---|---|---|
| VEHICLE ID | CAR1 | ... |
| USER ID | USR1 | ... |
| TRAVELING DATE AND TIME | YMD1 | ... |
| TRAVELING SECTION | SCT1 | ... |
| TRAVELING DISTANCE | DIST1 | ... |
| NUMBER OF PASSENGERS | PNUM1 | ... |
| NUMBER OF TIMES OF SUDDEN STARTING | SNUM1 | ... |
| NUMBER OF TIMES OF ABRUPT STEERING | HNUM1 | ... |
| NUMBER OF TIMES OF SUDDEN BRAKING | BNUM1 | ... |

INFORMATION PROCESSING APPARATUS AND INFORMATION PROCESSING METHOD

CROSS REFERENCE TO RELATED APPLICATION

This application claims the benefit of Japanese Patent Application No. 2018-112084, filed on Jun. 12, 2018, which is hereby incorporated by reference herein in its entirety.

BACKGROUND

Technical Field

The present disclosure relates to an information processing apparatus and an information processing method.

Description of the Related Art

Conventionally, in a transport mode where a plurality of users share a ride on the same vehicle, a technique of making a request to a ride-sharing provider in accordance with a time taken in the case where the vehicle goes through a drop-off location designated by a ride-sharing applicant on the basis of a past travel route of the vehicle, is known (Patent document 1).

CITATION LIST

Patent Document

[Patent document 1] Japanese Patent Laid-Open No. 2015-191364

The present disclosure is directed to providing a technique of encouraging a driver of a vehicle to provide ride sharing of the vehicle.

SUMMARY

One aspect of the present disclosure is an information processing apparatus including a controller configured to:

acquire information indicating driving history regarding traveling of a vehicle;

specify a traveling section having a distance equal to or longer than a predetermined distance, in which the vehicle repeatedly travels at a frequency equal to or higher than a predetermined frequency, on a basis of the information indicating the driving history; and send a notification to a driver of the vehicle for encouraging the driver to provide ride sharing using the vehicle in the specified traveling section.

Another aspect of the present disclosure is an information processing method performed by a computer, including:

acquiring information indicating driving history regarding traveling of a vehicle;

specifying a traveling section having a distance equal to or longer than a predetermined distance, in which the vehicle repeatedly travels at a frequency equal to or higher than a predetermined frequency on a basis of the information indicating the driving history; and sending a notification to a driver of the vehicle for encouraging the driver to provide ride sharing using the vehicle in the specified traveling section.

According to the present disclosure, it is possible to encourage a driver of a vehicle to provide ride sharing of the vehicle.

BRIEF DESCRIPTION OF DRAWINGS

FIG. 3 is a diagram illustrating an example of a configuration of a driving history information table according to an embodiment;

DESCRIPTION OF THE EMBODIMENTS

Figure 1:
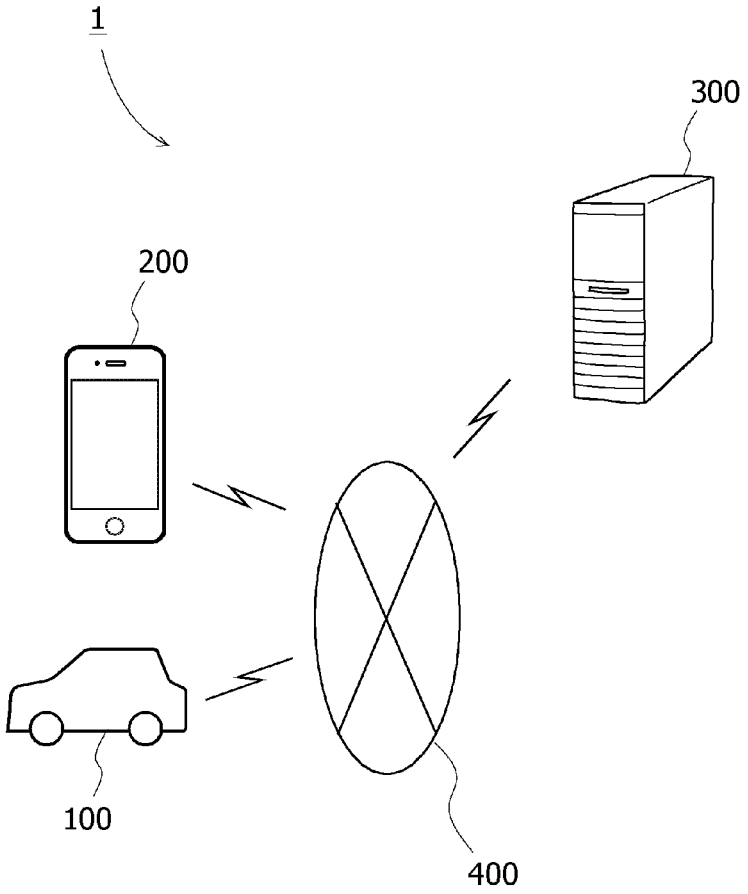
FIG. 1 is a system schematic diagram illustrating an example of an evaluation system according to an embodiment.

Ride sharing of a vehicle is still unfamiliar, and it can be considered that there is a user among users of vehicles, who does not know that he/she can provide ride sharing or who does not know advantages by providing ride sharing. Here, providing ride sharing of a vehicle means allowing other users to share a ride on the vehicle when the user drives the vehicle to a destination as a driver.

An information processing apparatus according to one aspect of the present disclosure includes a controller. The controller may be configured to acquire information indicating driving history regarding traveling of a vehicle, specify a traveling section having a distance equal to or longer than a predetermined distance, in which the vehicle repeatedly travels at a frequency equal to or higher than a predetermined frequency, on the basis of the information indicating the driving history, and send a notification to a driver of the vehicle for encouraging the driver to provide ride sharing using the vehicle in the specified traveling section.

Further, an information processing method according to one aspect of the present disclosure which is performed by a computer, including acquiring information indicating driving history regarding traveling of a vehicle, specifying a traveling section having a distance equal to or longer than a predetermined distance, in which the vehicle repeatedly travels at a frequency equal to or higher than a predetermined frequency, on the basis of the information indicating the driving history, and sending a notification to a driver of the vehicle for encouraging the driver to provide ride sharing using the vehicle in the specified traveling section.

According to the above-described aspect, it can be expected that ride sharing of a vehicle becomes more familiar by a driver of the vehicle who repeatedly travels in the same traveling section at a frequency equal to or higher than the predetermined frequency being notified that he/she can become a provider of ride sharing in the section.

In one aspect of the present disclosure, the driving history includes operation history of the vehicle by the driver. Then, the controller may determine whether or not driving skills of the driver for the vehicle satisfy predetermined standards, on the basis of operation history, and, in the case where it is determined that the driving skills satisfy the predetermined standards, the controller makes a notification to the driver, while, in the case where it is determined that the driving skills do not satisfy the predetermined standards, the controller does not make a notification to the driver.

Further, in one aspect of the present disclosure, the controller may acquire information indicating past results of ride sharing in the specified traveling section, specify information including at least one of a demand for ride sharing, financial benefits to the driver in ride sharing, and the number of drivers who can provide ride sharing in the specified traveling section, on the basis of the information indicating the past results, and include a notification of the specified information in the above-described notification.

Hereinafter, an embodiment of the present disclosure will be described with reference to the drawings. The configuration of the following embodiment is merely an example, and the present disclosure is not limited to the configuration of the embodiment.

First Embodiment (Outline of System)

A first embodiment of the present disclosure will be described below using an example of a case where the present disclosure is applied to an evaluation system which evaluates aptitude of a user who is a driver of a vehicle as a driver who provides ride sharing to other users.

FIG. 1 is a diagram illustrating a schematic configuration of an evaluation system 1 according to the present embodiment. The evaluation system 1 includes a vehicle 100, a terminal 200 which is used by a user who is a driver of the vehicle 100, and a management server 300. It is assumed in the present embodiment that the user who is the driver of the vehicle 100 drives the vehicle 100 and travels in the same long-distance traveling section at a frequency equal to or higher than a predetermined frequency. Here, the same traveling section means a traveling route having the same point of departure and the same point of arrival, and may include a section having different traveling routes of the vehicle 100 such as general roads and expressways if the point of departure and the point of arrival are the same. Further, the long distance assumes a case where, for example, the traveling distance is equal to or longer than 100 kilometers. Further, traveling at the frequency equal to or higher than the predetermined frequency means, for example, traveling once or more a month, several or more times a year, or the like. These terms have similar meaning in the following description. Note that definition of the above-described traveling section, traveling distance and traveling frequency are not limited to the above.

In the evaluation system 1, the vehicle 100, the terminal 200 and the management server 300 are connected to each other via a network 400. As the network 400, for example, a WAN (Wide Area Network) which is a global-scale public communication network such as the Internet and other communication networks may be employed. Further, the network 400 may include a telephone communication network such as a mobile phone and a wireless communication network such as WiFi.

The vehicle 100 includes a dedicated communication device which stores driving data of the vehicle 100 and performs communication with the management server 300. The driving data includes various kinds of data relating to driving history regarding traveling of the vehicle 100 such as vehicle speed upon traveling of the vehicle 100, acceleration, driving operation by the user such as brake operation and steering wheel operation, and measurements of various kinds of sensors. The management server 300 regularly receives driving data of the vehicle 100 from the dedicated communication device mounted on the vehicle 100. Here, regularly receiving driving data of the vehicle 100 means, for example, receiving driving data of the vehicle 100 at a specific time interval. For example, the driving data of the vehicle 100 may be received every time the driving of the vehicle 100 is stopped, the vehicle 100 is powered off after the vehicle 100 is powered on, a vehicle motor of the vehicle 100 is stopped after the vehicle motor of the vehicle 100 is started, or the like. Note that the management server 300 corresponds to an "information processing apparatus" according to one aspect of the present disclosure.

Further, the management server 300 performs evaluation of aptitude (hereinafter, referred to as aptitude evaluation) of a user who drives the vehicle 100 as the driver who provides ride sharing on the basis of the driving data received from the dedicated communication device of the vehicle 100. Further, predetermined application for allowing the user to confirm content of the aptitude evaluation by the management server 300 is installed at the vehicle 100 and the terminal 200. The user who is a driver of the vehicle 100 and who is a user of the terminal 200 can confirm a result of the aptitude evaluation by the management server 300 by causing the application to be run at the vehicle 100 or the terminal 200. Note that details of processing when the management server 300 performs aptitude evaluation will be described later.

(System Configuration)

Figure 2:
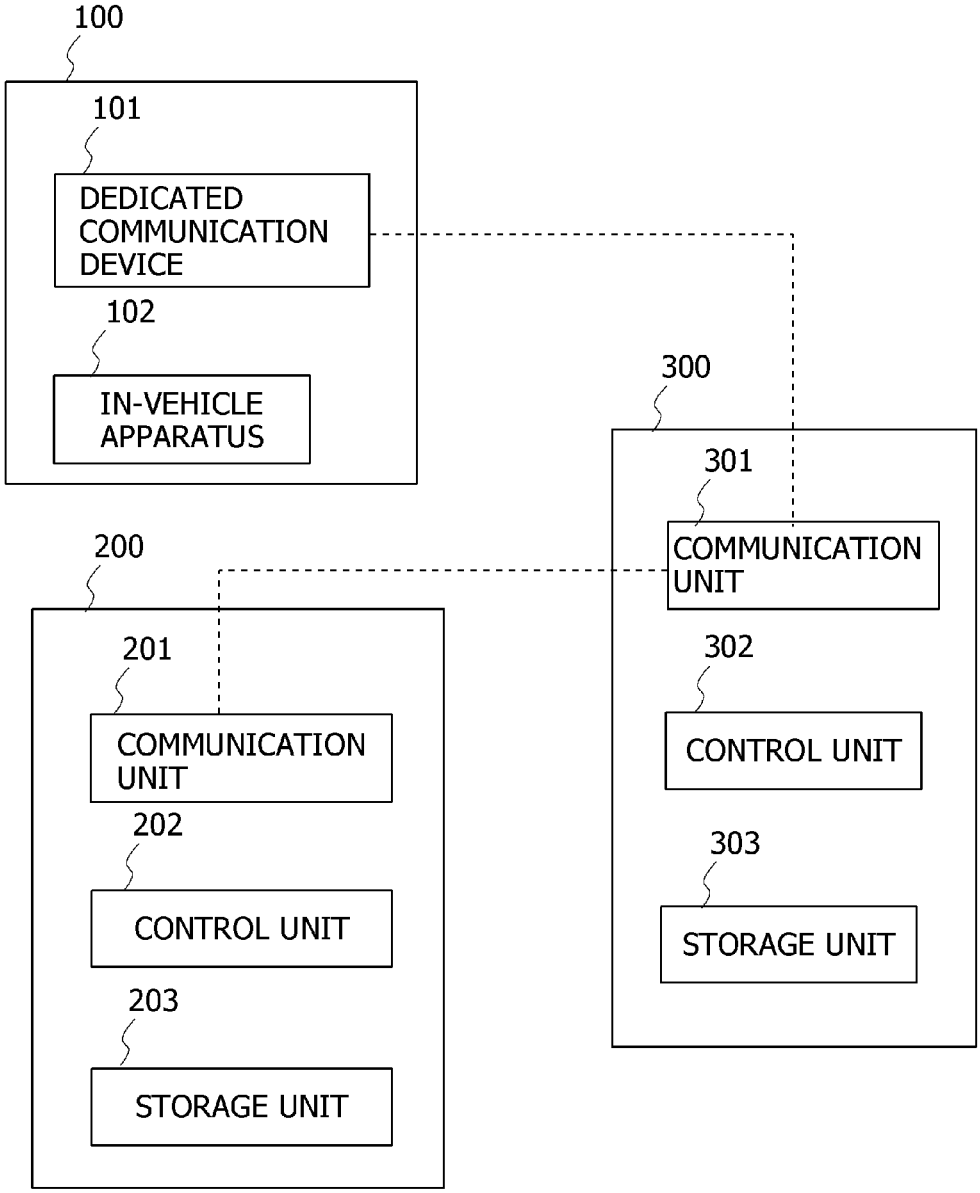
FIG. 2 is a block diagram illustrating an example of configurations of a vehicle, a terminal and a management server according to an embodiment.

FIG. 2 is a block diagram schematically illustrating an example of configurations of the vehicle 100, the terminal 200 and the management server 300 which constitute the evaluation system 1 according to the present embodiment. Hardware configurations and functional configurations of the vehicle 100, the terminal 200 and the management server 300 will be described below on the basis of FIG. 2.

(Vehicle)

The vehicle 100 includes the above-described dedicated communication device 101, and driving data regarding traveling of the vehicle 100 is transmitted to the management server 300 by the dedicated communication device 101. Further, the vehicle 100 includes an in-vehicle apparatus 102 for estimating the number of passengers of the vehicle 100. Examples of the in-vehicle apparatus 102 can include a communication device which communicates with a terminal carried by a user who rides on the vehicle 100, an in-vehicle camera provided within the vehicle 100, a seating sensor, a weight sensor, or the like, attached on each seat of the vehicle 100. Note that, because estimation of the number of passengers of the vehicle 100 by the in-vehicle apparatus 102 can be achieved using a well-known technique, detailed description will be omitted here. Data generated by the in-vehicle apparatus 102 is also transmitted from the dedicated communication device 101 to the management server 300.

(Terminal)

The terminal 200 is a small computer such as, for example, a smartphone, a tablet computer, a mobile computer, a wearable computer, a wireless storage, a mobile phone and a handy terminal. Further, the terminal 200 may be a personal computer (PC) which is connected to the management server 300 via the network 400.

The terminal 200 includes a communication unit 201, a control unit 202 and a storage unit 203. The communication unit 201 is communication means for connecting the terminal 200 to the network 400. Further, the communication unit 201 can perform communication with other apparatuses including the management server 300 by way of the network 400 by utilizing mobile communication service such as, for example 3G (3rd Generation) and LTE (Long Term Evolution). Further, the control unit 202 is a computer which manages control of the terminal 200. Further, the control unit 202 is constituted with, for example, a microcomputer, and causes various kinds of functions which will be described later to be implemented by causing a program stored in the storage unit 203 to be executed by a CPU.

(Management Server)

The management server 300 will be described next. The management server 300 is constituted with a general computer. That is, the management server 300 is a computer including a processor such as a CPU (Central Processing Unit) and a DSP (Digital Signal Processor), a main memory unit such as a RAM (Random Access Memory) and a ROM (Read Only Memory), and an auxiliary storage unit such as an EPROM (Erasable Programmable ROM), a hard disk drive (HDD) and a removable medium. Note that the removable medium is, for example, a USB (Universal Serial Bus) memory or a disk recording medium such as a CD (Compact Disc) and a DVD (Digital Versatile Disc). In the auxiliary storage unit, an operating system (OS), various kinds of programs, various kinds of tables, or the like, are stored, and, each function in accordance with predetermined purpose can be implemented as will be described later by the programs stored therein being loaded to a work area of the main memory unit and executed, and each component, or the like, being controlled through execution of the programs. However, part or all of the functions may be implemented with a hardware circuit such as an ASIC and an FPGA. Note that the management server 300 may be constituted with a single computer or may be constituted with a plurality of computers which coordinate with each other.

The management server 300 receives the above-described various kinds of data from the vehicle 100 by way of the network 400. Further, the management server 300 performs aptitude evaluation on the basis of the data received from the vehicle 100. Further, the management server 300 transmits data indicating a result of the aptitude evaluation to the terminal 200.

The management server 300 includes a communication unit 301, a control unit 302 and a storage unit 303. The communication unit 301 is communication means for connecting the management server 300 to the network 400. The communication unit 301 includes, for example, a LAN (Local Area Network) interface board and a wireless communication circuit for wireless communication. Further, the control unit 302 is a computer which manages control of the management server 300. Further, the control unit 302 is constituted with, for example, a microcomputer, and causes various kinds of functions which will be described later to be implemented by causing programs stored in the storage unit 303 to be executed by the CPU. Further, the storage unit 303 stores, for example, various kinds of data received from the vehicle 100, data indicating the result of the aptitude evaluation, or the like.

FIG. 3 illustrates a configuration of a driving history information table which stores various kinds of information regarding driving history of the vehicle 100, stored in the storage unit 303 of the management server 300. The management server 300 stores information in each field of the table illustrated in FIG. 3 on the basis of the driving data received from the vehicle 100.

A vehicle ID is identification information ("CAR1" in the figure) for uniquely identifying a vehicle in the evaluation system 1 in the present embodiment. A user ID is identification information ("USR1" in the figure) for identifying a driver of a vehicle. Traveling date and time is information ("YMD1" in the figure) indicating date and time at which the vehicle travels. A traveling section is information ("SCT1" in the figure) indicating a section in which the vehicle travels. A traveling distance is information ("DIST1" in the figure) indicating a traveling distance when the vehicle travels in the traveling section. The number of passengers is information ("PNUM1" in the figure) indicating the number of passengers of the vehicle during traveling, estimated on the basis of data output by the in-vehicle apparatus for estimating the number of passengers, which is mounted on the vehicle. The number of times of sudden starting, the number of times of abrupt steering, and the number of times of sudden braking are information (respectively, "SNUM1", "HNUM1" and "BNUM1" in the figure) indicating the number of times of occurrence of respective driving operation of sudden starting, abrupt steering and sudden braking of the vehicle by the user during traveling. Because calculation of the number of times of occurrence of respective driving operations of sudden starting, abrupt steering and sudden braking can be achieved using a well-known technique, detailed description will be omitted here. In the driving history information table, respective information pieces in the above-described respective fields in one-time traveling are stored in association with each other.

(Processing flow)

Figure 4:
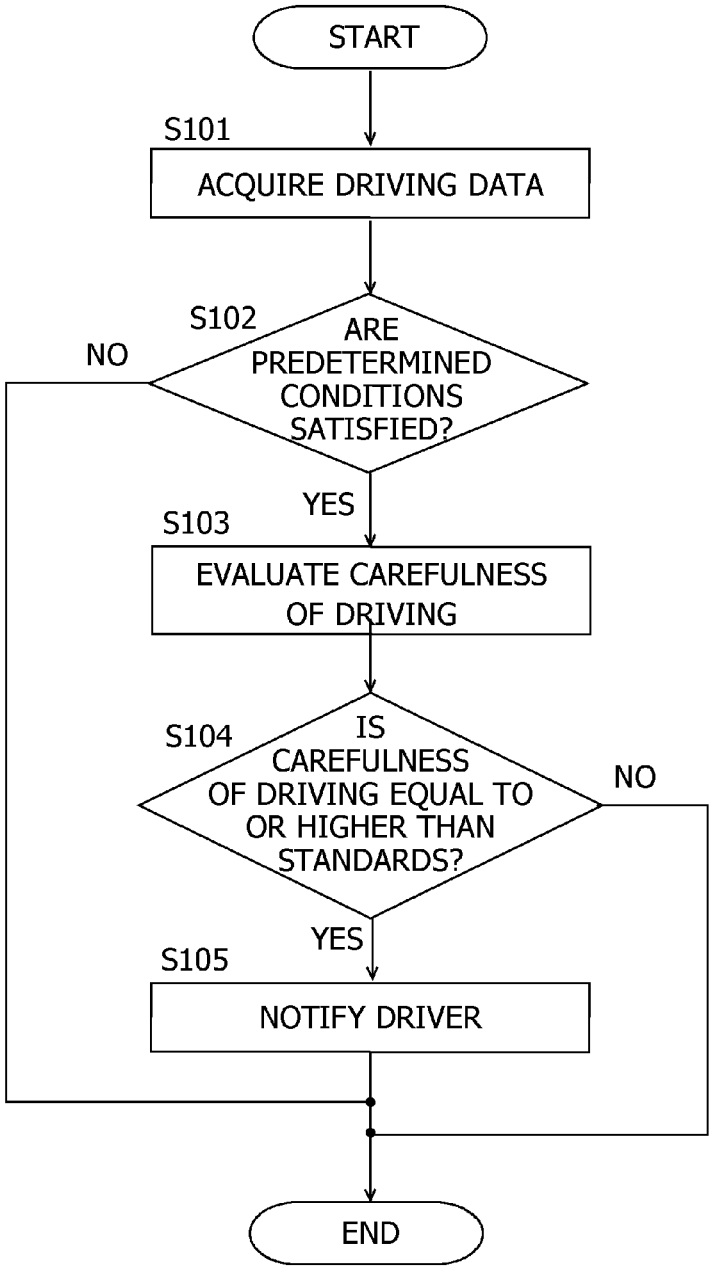
FIG. 4 is a flowchart illustrating an example of flow of notification processing according to an embodiment.

Processing flow in the evaluation system of the present embodiment will be described below with reference to FIG. 4. In the present embodiment, by the control unit 302 of the management server 300 executing the processing in FIG. 4, aptitude of the user of the vehicle 100 as a driver who provides ride sharing is evaluated.

First, in S101, the control unit 302 of the management server 300 performs communication with the dedicated communication device 101 of the vehicle 100 and receives driving data of the vehicle 100. The control unit 302 stores each information included in the received driving data in each field of the above-described driving history information table. Note that a case can be also assumed where the driving data does not include information corresponding to each field. In this case, the control unit 302 may calculate information corresponding to each field on the basis of the received driving data and store the calculated information in each field. For example, the control unit 302 calculates the number of times of sudden starting during traveling on the basis of data of acceleration of the vehicle 100 included in the driving data and stores the calculated number of times of sudden starting in a field of "the number of times of sudden starting" of the driving operation history table.

Then, in S102, the control unit 302 determines whether or not predetermined conditions are satisfied on the basis of information associated with the vehicle 100, stored in the driving history information table in S101. In the present embodiment, as an example, the following conditions (1) to (4) are set as the "predetermined conditions".

(1) There exists the same traveling section in traveling by the same vehicle.

(2) A traveling distance of the same traveling section in (1) is a long distance.

(3) Traveling date and time in the same traveling section in (1) corresponds to a predetermined frequency.

(4) The number of passengers of the vehicle in traveling in the same traveling section in (1) is one.

The control unit 302 determines that the predetermined conditions are satisfied in the case where information in each field associated with the vehicle 100 satisfies the above-described conditions (1) to (4). Further, the control unit 302 determines that the predetermined conditions are not satisfied in the case where information in each field associated with the vehicle 100 does not satisfy one of the above-described conditions (1) to (4). In the case where the control unit 302 determines that the predetermined conditions are satisfied (S102: Yes), the control unit 302 proceeds with the processing to S103. Meanwhile, in the case where the control unit 302 determines that the predetermined conditions are not satisfied (S102: No), the control unit 302 finishes processing of the present flowchart.

In S103, the control unit 302 evaluates carefulness (roughness) of driving of the user of the vehicle 100 on the basis of each information in a field of "the number of times of sudden starting", a field of "the number of times of abrupt steering" and a field of "the number of times of sudden braking" associated with the vehicle 100, stored in the driving history information table. Note that, because evaluation of carefulness of the driving based on the number of times of sudden starting, the number of times of abrupt steering and the number of times of sudden braking can be achieved using a well-known technique, details of specific evaluation will be omitted here. Further, the carefulness (roughness) of driving corresponds to "driving skills" according to one aspect of the present disclosure. Then, in S104, the control unit 302 determines whether or not carefulness of driving of the user of the vehicle 100 is equal to or higher than standards on the basis of the evaluation result in S103. Here, examples of the standards of carefulness of the driving can include a threshold to be compared with an index which is a numerical value expressing carefulness of driving in the evaluation result in S103. Further, the carefulness of driving may be evaluated for each time of traveling or may be evaluated for the whole of a plurality of times of traveling. Alternatively, instead of the above-described determination, whether or not the number of times (frequency) that carefulness of driving in a plurality of times of traveling becomes equal to or higher than the standards becomes equal to or higher than a threshold may be determined. In the case where the control unit 302 determines that the carefulness of driving of the user of the vehicle 100 is equal to or higher than the standards (S104: Yes), the control unit 302 proceeds with the processing to S105. Meanwhile, in the case where the control unit 302 determines that the carefulness of driving of the user of the vehicle 100 is less than the standards (S104: No), the control unit 302 finishes processing of the present flowchart.

In S105, the control unit 302 notifies the user of the vehicle 100 that the user has aptitude as a driver who provides ride sharing in a traveling section which is the same as the traveling section in which determination is performed in S102. Note that, this notification corresponds to "notification for encouraging the driver to provide ride sharing of a vehicle" according to one aspect of the present disclosure. As a notification method, at the terminal 200 used by the user of the vehicle 100, application for making a diagnosis as to the above-described aptitude is executed, and the above-described notification can be made by the application. In this case, the control unit 302 generates information regarding the above-described notification and transmits the information to the terminal 200. Further, in the case where the vehicle 100 includes a car navigation apparatus, the above-described notification may be made to the user of the vehicle 100 via the car navigation apparatus. In this case, the control unit 302 generates information regarding the above-described notification and transmits the information to the vehicle 100. Further, the control unit 302 may make the above-described notification through e-mail transmission to the terminal 200. In this case, the control unit 302 transmits an e-mail including the information regarding the above-described notification to the terminal 200.

According to the present embodiment, by causing the user of the vehicle 100 which repeatedly travels in the same section to recognize ride-sharing service, it is possible to encourage the user to provide ride sharing to other users. Further, by this means, it can be expected that ride sharing of a vehicle becomes more familiar and supply of vehicles to be provided to be utilized for ride sharing increases.

Second Embodiment

A second embodiment will be described next. Note that, in the present embodiment, the same reference numerals are assigned to configurations and processing similar to those in the above-described embodiment, and detailed description will be omitted.

Figure 5:
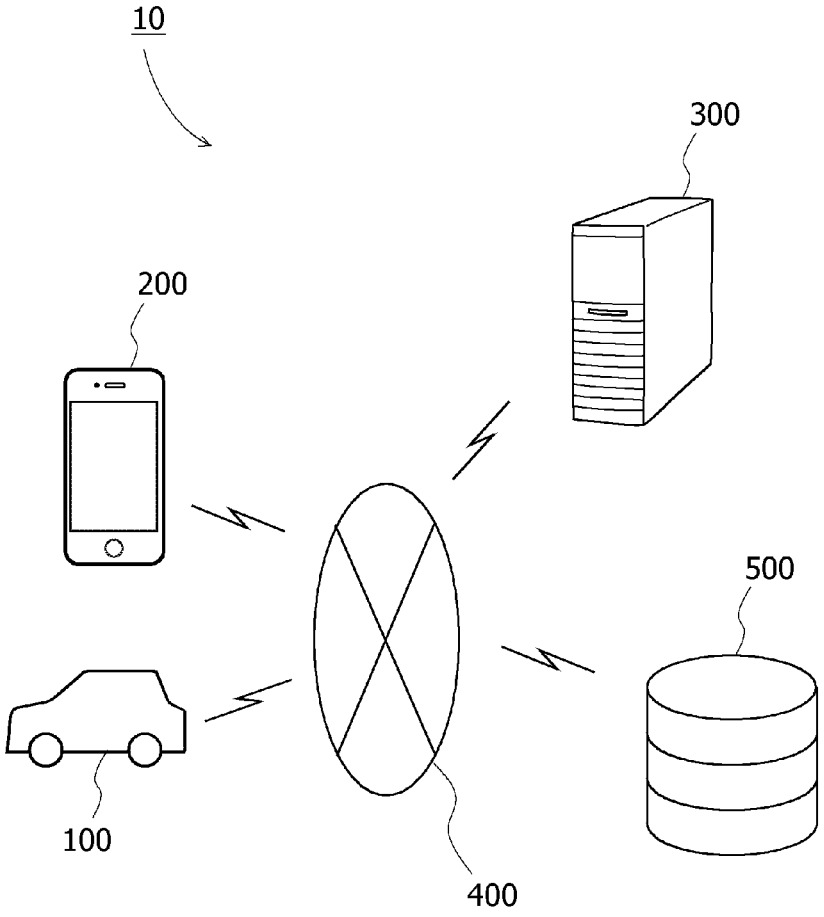
FIG. 5 is a system schematic diagram illustrating an example of an evaluation system according to another embodiment.

FIG. 5 is a diagram illustrating a schematic configuration of an evaluation system according to the present embodiment. In the evaluation system 10 of the present embodiment, a server 500 which is used for providing service relating to match between a driver of a vehicle and a user who desires to share a ride on the vehicle is connected to a network 400. The server 500 may be used by a third party such as a company which provides the service. In the server 500, various kinds of data indicating utilization history of ride-sharing service such as date and time at which ride sharing is provided, a traveling section of a vehicle used for ride sharing, and consideration paid to the driver of the vehicle are stored. The data may include request history of ride sharing, that is, information regarding a section in which the user desires ride sharing. The management server 300 receives these kinds of data from the server 500.

Examples of the consideration in the present embodiment can include an amount paid by a passenger of the vehicle out of actual cost relating to traveling of the vehicle such as fuel expense of the vehicle and toll. Further, the consideration may be compensation to be paid to the driver of the vehicle within a limit allowed in laws and regulations (laws or rules). Note that the consideration paid to the driver of the vehicle corresponds to "financial benefits" according to one aspect of the present disclosure. The financial benefits can be regarded as transportation cost reduced by provision of ride sharing.

(Processing Flow)

Figure 6:
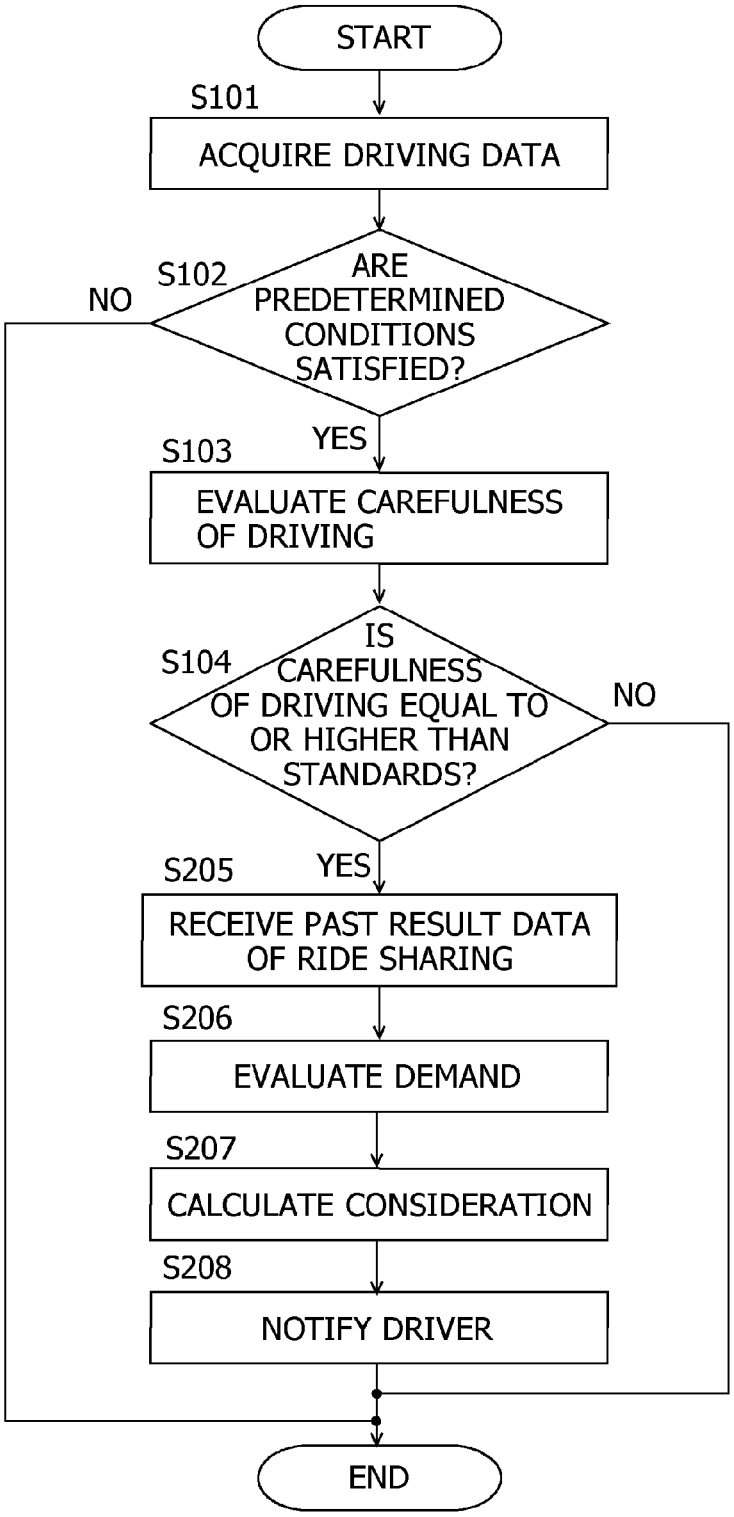
FIG. 6 is a flowchart illustrating an example of flow of notification processing according to another embodiment.

Processing flow in the evaluation system 10 will be described below with reference to FIG. 6. In the present embodiment, the control unit 302 of the management server 300 evaluates aptitude of the user of the vehicle 100 as a driver who provides ride sharing. Further, the control unit 302 provides information indicating a demand for ride sharing from other users, information regarding consideration based on past results, or the like, in the traveling section in which ride sharing is to be performed, to the user of the vehicle 100 by executing the processing in FIG. 6. Because the processing from S101 to S104 is the same as described above, description will be omitted.

In S205, the control unit 302 receives data regarding utilization history of ride sharing in a traveling section which is the same as the traveling section in which determination is performed in S102, from the server 500. Further, the control unit 302 also receives data regarding past request history of ride sharing from users in the traveling section from the server 500. Still further, the control unit 302 also receives data regarding consideration paid by a user who has utilized ride sharing to a driver of the vehicle in ride sharing in the traveling section which is the same as the traveling section in which determination is performed in S102, from the server 500. Note that these kinds of data received by the control unit 302 from the server 500 correspond to "information indicating a past result of ride sharing" according to one aspect of the present disclosure.

Then, in S206, the control unit 302 evaluates a demand for ride sharing in the traveling section on the basis of the data received from the server 500. As an example, the control unit 302 determines a demand for ride sharing on the basis of whether or not the number of times of past utilization of ride sharing or the number of times of request in the traveling section is equal to or larger than a threshold and sets the determination result as the above-described evaluation of the demand. Then, in S207, the control unit 302 calculates an average amount of consideration paid to the driver of the vehicle in ride sharing in the traveling section on the basis of the acquired data.

Then, in S208, the control unit 302 notifies the user of the vehicle 100 that he/she has aptitude as a driver who provides ride sharing in a traveling section which is the same as the traveling section in which determination is performed in S102. Further, the control unit 302 also notifies the user of the evaluation result of the demand in the traveling section in S206 and the calculation result of the consideration for ride sharing in the traveling section in S207. Note that the method described in S105 may be employed as the notification method.

According to the present embodiment, because the user of the vehicle 100 which repeatedly travels in the same section is caused to recognize ride-sharing service, and information regarding the demand and the consideration of ride sharing in the section is also provided, it is possible to induce the user of the vehicle 100 to become a driver who provides ride sharing and encourage the user to provide ride sharing to other users. Further, by this means, it can be expected that ride sharing of a vehicle becomes more familiar, and supply of vehicles to be provided to be utilized for ride sharing increases.

Other Embodiments

The embodiment described above is an example, and the present disclosure may be changed and carried out as appropriate without departing from the gist of the present disclosure.

For example, in the above-described embodiments, a case can be assumed where there exists seasonal tendency of traveling such as the user of the vehicle 100 repeatedly traveling in the same traveling section just on weekends, or during the year-end through New Year holiday season. The control unit 302 may specify seasonal tendency of traveling in the same traveling section on the basis of information of traveling date and time of the vehicle 100 stored in the above-described driving history information table, calculate a demand, consideration, or the like, of ride sharing in the season on the basis of past utilization of ride sharing in the specified season among data acquired from the server 500 and notify the user of the information in a similar manner as described above.

Further, while, in the above-described embodiments, aptitude of the user of the vehicle 100 as a driver of ride sharing is evaluated, aptitude of users of other vehicles may be evaluated in a similar manner as described above. By aptitude of a plurality of users as a driver being evaluated, it is possible to notify the users to be evaluated of the number of users who have aptitude as a driver of ride sharing, information regarding a ratio between the number of users as a driver of ride sharing and the number of users as an applicant for ride sharing, or the like, in the same traveling section.

Further, concerning the condition (1) included in the predetermined conditions in the above-described embodiments, a condition may be set such that, in place of or in addition to the same vehicle, there exists traveling history of a vehicle by the same user in the same traveling section. By this means, also in the case where the same user drives different vehicles in the same traveling section, it is possible to encourage the user to provide ride sharing through the above-described processing. Further, concerning the condition (4) included in the predetermined conditions in the above-described embodiments, a condition may be set such that, in place of the number of passengers being one, the number of passengers is equal to or smaller than the predetermined number of passengers, the number of vacant seats is equal to or larger than the predetermined number of seats, or the like. Here, the predetermined number of passengers and the predetermined number of seats which are thresholds for determining the number of passengers may be determined on the basis of, for example, riding capacity of the vehicle.

The processes and means described in the present disclosure may be freely combined to the extent that no technical conflict exists.

A process which is described to be performed by one device may be performed divided among a plurality of devices. Processes described to be performed by different devices may be performed by one device. Each function is to be implemented by which hardware component (server component) in a computer system may be flexibly changed.

The present disclosure may also be implemented by supplying a computer program for implementing a function described in the embodiment above to a computer, and by reading and executing the program by at least one processor of the computer. Such a computer program may be provided to a computer by a non-transitory computer-readable storage medium which is connectable to a system bus of a computer, or may be provided to a computer through a network. The non-transitory computer-readable storage medium may be any type of disk such as a magnetic disk (floppy (registered trademark) disk, a hard disk drive (HDD), etc.), an optical disk (CD-ROM, DVD disk, Blu-ray disk, etc.), a read only memory (ROM), a random access memory (RAM), an EPROM, an EEPROM, a magnetic card, a flash memory, an optical card, and any type of medium which is suitable for storing electronic instructions.

What is claimed is:

1. An information processing apparatus comprising a controller configured to:

acquire information indicating driving history regarding traveling of a vehicle;

specify a traveling section having a distance equal to or longer than a predetermined distance, in which the vehicle repeatedly travels at a frequency equal to or higher than a predetermined frequency, on a basis of the information indicating the driving history; and send a notification to a driver of the vehicle for encouraging the driver to provide ride sharing using the vehicle in the specified traveling section.

2. The information processing apparatus according to claim 1, wherein the driving history includes operation history of the vehicle by the driver, the controller is configured to determine whether or not a driving skill of the driver for the vehicle satisfies a predetermined standard on a basis of the operation history, when it is determined that the driving skill satisfies the predetermined standard, to make the notification to the driver, and when it is determined that the driving skill does not satisfy the predetermined standard, not to send the notification to the driver.

3. The information processing apparatus according to claim 1, wherein the controller is configured to acquire information indicating a past result of ride sharing in the specified traveling section, specify information including at least one of a demand for ride sharing, a financial benefit to a driver in ride sharing and a number of drivers who are capable of providing ride sharing in the specified traveling section on a basis of the information indicating the past result, and include a notification of the specified information in the notification.

4. An information processing method performed by a computer, comprising:

acquiring information indicating driving history regarding traveling of a vehicle;

specifying a traveling section having a distance equal to or longer than a predetermined distance, in which the vehicle repeatedly travels at a frequency equal to or higher than a predetermined frequency on a basis of the information indicating the driving history; and sending a notification to a driver of the vehicle for encouraging the driver to provide ride sharing using the vehicle in the specified traveling section.

5. A non-transitory computer-readable medium recorded with a program for causing a computer to execute:

acquiring information indicating driving history regarding traveling of a vehicle;

specifying a traveling section having a distance equal to or longer than a predetermined distance, in which the vehicle repeatedly travels at a frequency equal to or higher than a predetermined frequency on a basis of the information indicating the driving history; and sending a notification to a driver of the vehicle for encouraging the driver to provide ride sharing using the vehicle in the specified traveling section.

* * * * *